US006176321B1

(12) United States Patent
Arakawa et al.

(10) Patent No.: US 6,176,321 B1
(45) Date of Patent: Jan. 23, 2001

(54) POWER-DRIVEN HAMMER DRILL HAVING AN IMPROVED OPERATING MODE SWITCH-OVER MECHANISM

(75) Inventors: Takuo Arakawa, Hekinan; Toshiro Hirayama, Toyohashi; Shin Nakamura, Chiryu, all of (JP)

(73) Assignee: Makita Corporation, Anjo (JP)

( * ) Notice: Under 35 U.S.C. 154(b), the term of this patent shall be extended for 0 days.

(21) Appl. No.: 09/395,478

(22) Filed: Sep. 14, 1999

(30) Foreign Application Priority Data

Sep. 16, 1998 (JP) ..... 10-261891

(51) Int. Cl.[7] ..... E02D 7/02
(52) U.S. Cl. ..... 173/48; 173/29
(58) Field of Search ..... 173/48, 47, 29, 173/201, 104, 109, 117; 74/22 R, 22 A; 200/5 B, 5 C, 50.32

(56) References Cited

U.S. PATENT DOCUMENTS

| | | | | |
|---|---|---|---|---|
| 3,680,642 | * | 8/1972 | Kirn et al. | 173/48 |
| 3,834,468 | * | 9/1974 | Hettich et al. | 173/48 |
| 3,908,108 | * | 9/1975 | Hults | 200/5 B |
| 4,158,313 | * | 6/1979 | Smith | 173/47 |
| 4,236,588 | * | 12/1980 | Moldan et al. | 173/48 |
| 4,428,438 | * | 1/1984 | Holzer | 173/48 |
| 4,506,743 | * | 3/1985 | Grossman | 173/48 |
| 4,732,218 | * | 3/1988 | Neumaier et al. | 173/104 |
| 5,111,889 | * | 5/1992 | Neumaier | 173/48 |
| 5,664,634 | * | 9/1997 | McCracken | 173/48 |
| 5,842,527 | | 12/1998 | Arakawa et al. | 173/48 |

FOREIGN PATENT DOCUMENTS

| | | | | |
|---|---|---|---|---|
| 9-57650 | * | 9/1997 | (JP) | 173/48 |

* cited by examiner

*Primary Examiner*—Peter Vo
*Assistant Examiner*—Jim Calve
(74) *Attorney, Agent, or Firm*—Foley, Hoag & Eliot LLP

(57) ABSTRACT

A power-driven hammer drill 1 includes a rotary lever 8 for transmitting and disabling the transmission of the rotation of a motor 5 to a tool bit 4 and a slide lever 9 for transmitting and disabling the transmission of hammer blows to the tool bit 4. The rotary lever 8 is formed with a chamfer 52, whereas the slide lever 9 is formed with a straight portion 54 and a cut-out 53 which conforms to the circular edge of the rotary lever 8. When the slide lever 9 is in the lowermost position with the rotary lever 8 fitted in the cut-out 53, the rotary lever 8 is in the position to disconnect the rotation of the motor 5 to the tool bit 4, and while in this position, the slide lever 9 cannot be slid to its uppermost position, in which hammer blows cannot be transmitted to the tool bit 4. When the slide lever 9 is located in the uppermost position and the chamfer 52 of the rotary lever 8 is in the rearmost position, in which hammer blows cannot be transmitted to the tool bit 4 but rotation can be transmitted to the tool bit 4, the straight portion 54 opposes the chamfer 52 across a narrow gap so that the rotary lever 8 cannot be rotated to the rotation disabling position.

10 Claims, 11 Drawing Sheets

POWER-DRIVEN HAMMER DRILL HAVING AN IMPROVED OPERATING MODE SWITCH-OVER MECHANISM

This application claims priority on Japanese Patent Application No. 10-261891 filed on Sept. 16, 1998, the contents of which are incorporated herein by reference.

BACKGROUND OF THE INVENTION

1. Field of the Invention

The present invention relates generally to a hammer drill. More particularly, the present invention relates to a hammer drill having a rotation transmission mechanism which is provided between a motor and a tool bit attached to the top of a drill housing and which rotates the bit, and having a impact transmission mechanism provided also between the motor and the tool bit for transmitting hammer blows to the tool bit.

2. Description of the Related Art

It is a common practice in the art to which the present invention pertains to provide a change-over device for the rotation transmission mechanism and for the impact transmission mechanism for switching between transmission and disconnection of drive power from the motor, thus changing the operation mode of the hammer drill. The Applicant disclosed in Japan Published Unexamined Patent Application No. 9-57650 a large hammer drill which incorporates a crank mechanism, the contents of which are incorporated herein by reference. The hammer drill includes a sleeve which functions as a first change-over device for selectively transmitting rotation from the motor to the tool bit when slid to one position and disconnecting the motor rotation when slid to another position. The hammer drill additionally includes a link which functions as a second change-over device for selectively transmitting reciprocating motion of the piston to the tool bit when slid to one position and disconnecting the reciprocating motion when slid to another position. Moreover, a rotary selector knob is provided in this tool for allowing the operator to simultaneously select a combination of the slide positions of the two change-over devices, i.e., one of the three possible operation modes of the hammer drill. When a rotation-plus-hammer mode is selected, both rotation and hammer blows are transmitted to the tool holder. In a hammer-only mode, only hammer blows are transmitted to the tool holder. In a neutral mode, the tool bit is manually freely rotatable in either direction, thus allowing the operator to change the rotational angle of the tool bit.

From a viewpoint of convenience, it would be preferable to have such a large hammer drill with a crank mechanism as described above be able to operate in a rotation-only mode in addition to a rotation-plus-hammer mode and a hammer-only mode. The structure of the selector knob renders implementation of a rotation-only mode in the hammer drill very difficult. Significant changes in the design and thus increase in the manufacturing cost would be inevitable if these three modes are to be realized without altering the basic structures of the impact transmission mechanism and the rotation transmission mechanism. One possible means to achieve this goal is to provide two separate operating members for independently operating a sleeve provided for transmission of rotation separate and a link provided for transmission of hammer blows. One drawback of this configuration is that since each operating member has a position in which rotation or hammer blows are disconnected (an "off" state), the operator may unintentionally and inconveniently place the hammer drill in an off-off state, in which neither rotation nor hammer blows are transmitted to the tool bit, thus rendering the tool inoperative.

SUMMARY OF THE INVENTION

In view of the above-identified problems, an important object of the present invention is to provide a hammer drill with improved operability that allows change-over between three operating modes with two switching devices, such as levers, without inducing an "off-off" operational state.

The above object and other related objects are realized by the invention, which provides a hammer drill, comprising: a tool bit attached to a front end of the hammer drill; a motor for providing drive power for the tool bit; a rotation transmission mechanism provided between the tool bit and the motor for transmitting rotation of the motor to the tool bit; an impact transmission mechanism provided between the tool bit and the motor for transmitting hammer blows generated by the motor to the tool bit; a first change-over member associated with the rotation transmission mechanism for selectively enabling and disabling the rotation transmission mechanism to transmit the rotation of the motor to the tool bit; a second change-over member associated with the impact transmission mechanism for selectively enabling and disabling the impact transmission mechanism to transmit the hammer blows generated by the motor to the tool bit; a manually operable first operating member movable between operative and inoperative positions, wherein the first operating member, when in the operative position, operates the first change-over member so as to enable the rotation transmission mechanism and, when in the inoperative position, operates the first change-over member to disable the rotation transmission mechanism; a manually operable second operating member movable between operative and inoperative positions, wherein the second operating member, when in the operative position, operates the second change-over member so as to enable the impact transmission mechanism and, when in the inoperative position, operates the second change-over member to disable the impact transmission mechanism; and a lock means for, when one of the first and second operating members is in its inoperative position, coordinating with the other operating member so as to prohibit the other operating member from moving to its inoperative position, thus avoiding induction of an operating state of the hammer drill in which neither rotation nor hammer blows of the tool bit are available.

According to one aspect of the present invention, one of the first and second operating members is a circular rotary lever and the other operating member is a slide lever slidable tangentially to the rotary lever. Additionally, the lock means includes a cut-out formed in an edge of the slide lever for fitting the circumferential edge of the rotary lever so as to prevent the slide lever to slide when the slide lever is in its operative position, and a chamfer formed on a portion of the circumferential edge of the rotary lever such that when the rotary lever is rotated to the operative position, the chamfer is positioned adjacent the slide lever so as to allow the slide lever to slide, and when the rotary lever is rotated to the operative position and the slide lever is in its inoperative position, the chamfer closely opposes an edge of the slide lever so as to prohibit rotation of the rotary lever.

According to another aspect of the present invention, the first operating member is the rotary lever and the second operating member is the slide lever. Moreover, the rotary lever and the slide lever are disposed on a line parallel to a longitudinal axis of the tool bit, with the rotary lever interposed between the tool bit and the slide lever.

According to still another aspect of the present invention, the slide lever has a generally rectangular shape and is slidable on the rotary lever and perpendicularly to the parallel line between its operative and inoperative positions.

According to yet another aspect of the present invention, the rotary lever is rotated 180 degrees around a second axis from its inoperative position to its operative position, the second axis intersecting and oriented perpendicularly to the parallel line.

In accordance with another aspect of the present invention, the cut-out is formed in a portion of the long side of the slide lever which is adjacent to the rotary lever, leaving a portion of the long side intact where the cut-out is not formed. The intact side edge closely opposes the chamfer of the rotary lever when the rotary lever is in its operative position and the slide lever is in the inoperative position such that the rotary lever cannot be rotated back to its inoperative position unless the slide lever is slid back to its operative position.

In accordance with another aspect of the present invention, the first change-over member is a sleeve member which is rotatably disposed within a housing of the hammer drill about the longitudinal axis and slid along the longitudinal axis between an operative position, in which the rotation transmission mechanism is enabled, and an inoperative position, in which the rotation transmission mechanism is disabled. The sleeve member is interlocked with the rotation transmission mechanism so as to be rotated by the motor when in the operative position and is disengaged from the rotation transmission mechanism and secured to the housing so as to be prevented from rotating when in the inoperative position.

In one aspect, when the rotary lever is rotated approximately 90 degrees from either of the operative and inoperative positions to an intermediate position, the sleeve member is neither secured to the housing nor interlocked with the rotation transmission mechanism, thus permitting manual adjustment of the rotary angle of the sleeve member.

In another aspect, the rotary lever bears a mark adjacent to the chamfer for indicating the location of the first change-over member between its operative and inoperative positions.

To carry out the invention in one preferred mode, the impact transmission mechanism comprises a crank mechanism connected to the rotor for converting the rotation of the motor into reciprocation motion as the hammer blows. The second change-over member interlocks the motor to the crank mechanism when the slide lever is in the operative position, thus enabling the crank mechanism, whereas the second change-over member disengages the crank mechanism from the motor when the slide lever is in the inoperative position, thus disabling the crank mechanism.

Other general and more specific objects of the invention will in part be obvious and will in part be evident from the drawings and descriptions which follow.

BRIEF DESCRIPTION OF THE ATTACHED DRAWINGS

For a fuller understanding of the nature and objects of the present invention, reference should be made to the following detailed description and the accompanying drawings, in which.

DETAILED DESCRIPTION OF THE PREFERRED EMBODIMENT

A preferred embodiment according to the present invention will be described hereinafter with reference to the attached drawings.

Figure 1:
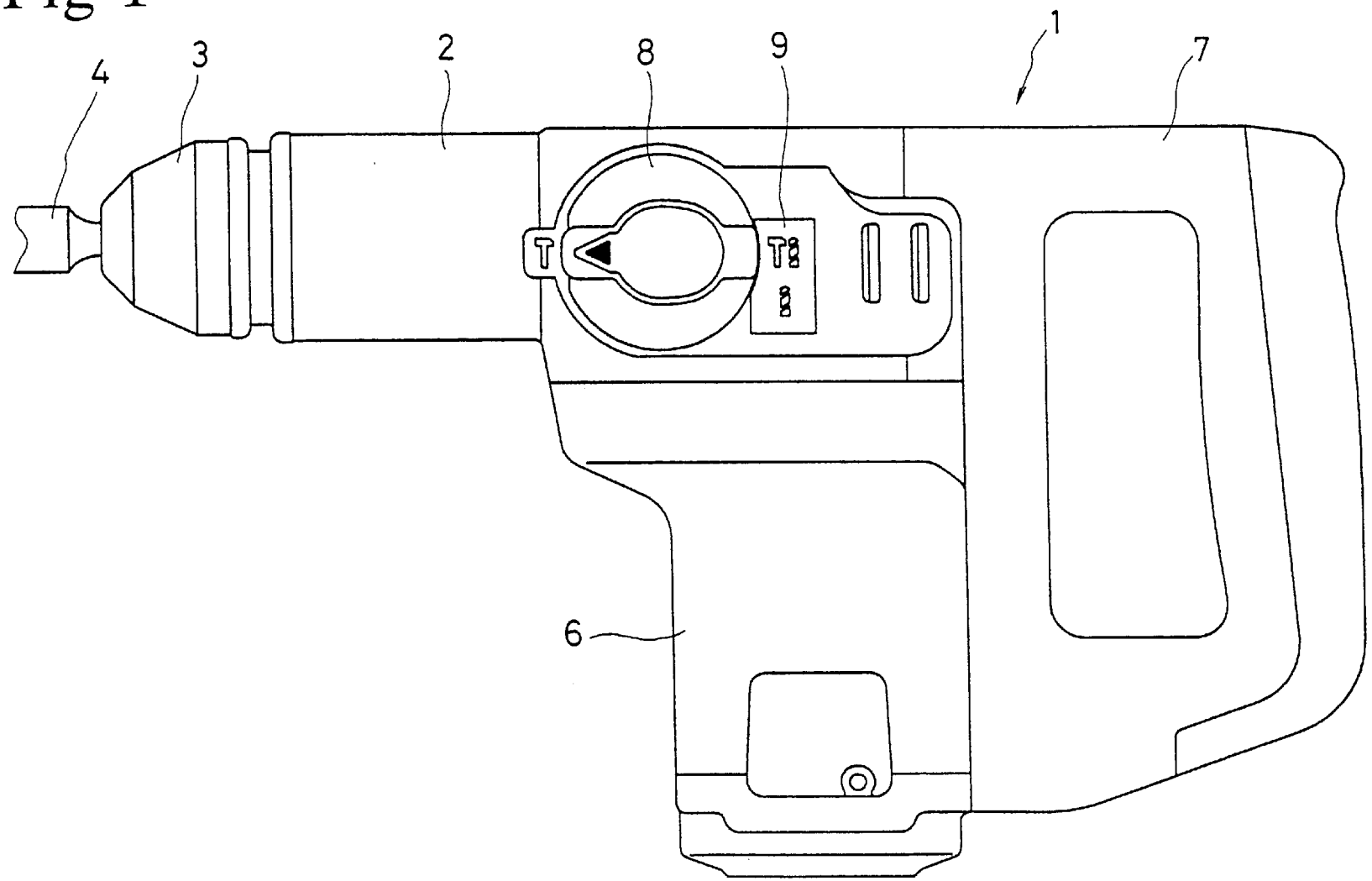
FIG. 1 is a side elevation of a power-driven hammer drill according to the present invention.
Figure 2:
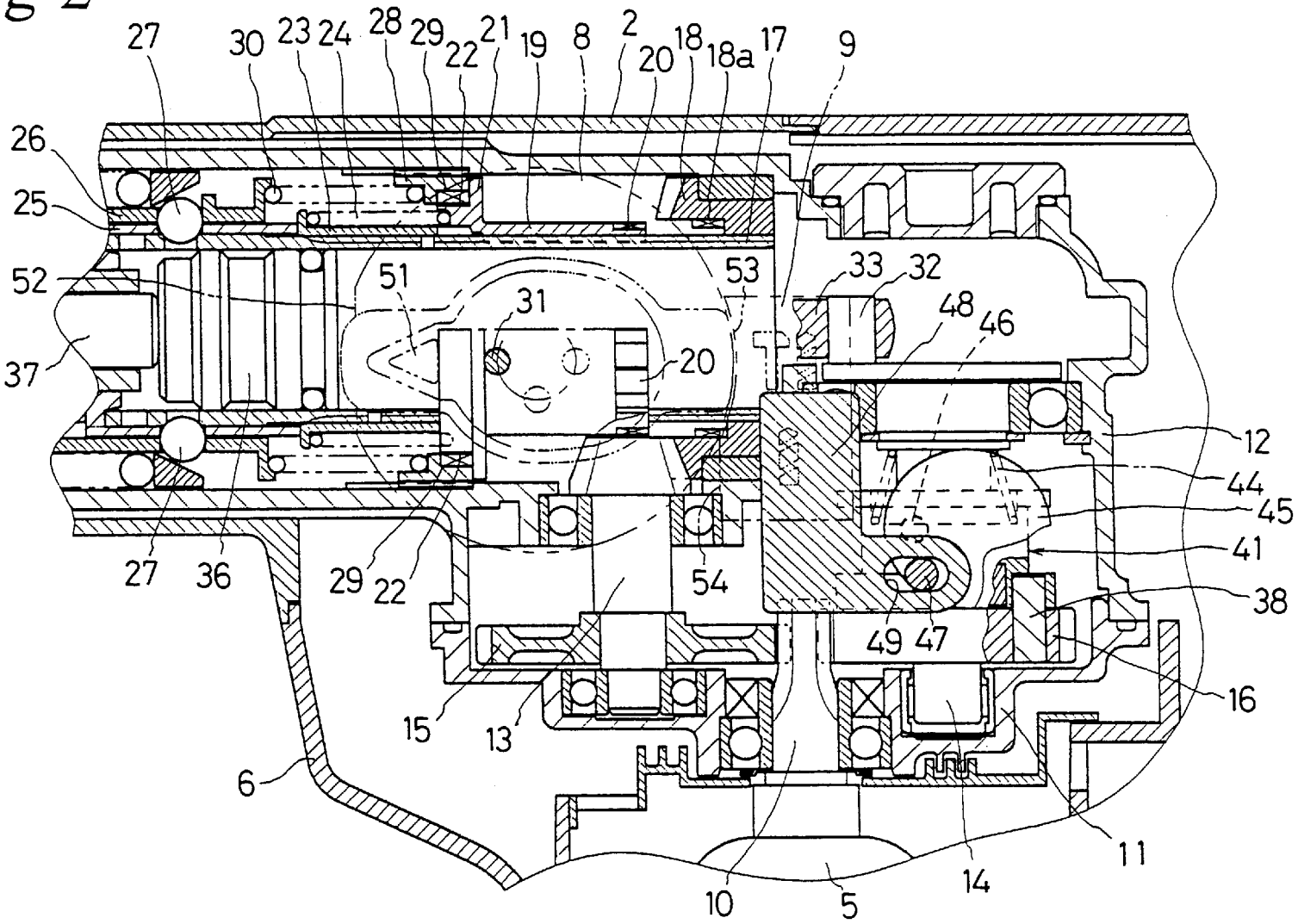
FIG. 2 is a partial cross section of essential internal mechanisms of the power-driven hammer drill of FIG. 1.

FIG. 1 is a side elevation of a power-driven hammer drill 1 according to the present invention, whereas FIG. 2 is a partial cross section of essential internal mechanisms of the power-driven hammer drill 1. The inverted L-shaped hammer drill 1 includes a main housing 2 and a chuck 3 for releasably attaching to a tool holder (described in detail below) a tool bit 4 which protrudes from the top of the drill 1 when attached. Connected to the lower rear portion of the main housing 2 is a motor housing 6 which vertically contains a motor 5. The hammer drill I further includes a handle housing 7 which provides a grip handle, a rotary lever 8 (a first operating member) for changing the operating mode of the hammer drill, and a slide lever 9 (a second operating member), also for operating mode change. The two levers 8 and 9 are provided on one side of the main housing 2 as shown in FIGS. 1 and 2. The slide lever 9 can be slid vertically and tangentially relative to the rotary lever 8.

Referring to FIG. 2, the motor 5 includes a motor shaft 10 which meshes with gears 15 and 16 of an intermediate shaft 13 and a crank shaft 14, respectively. The intermediate shaft 13 and the crank shaft 14 are oriented parallel to the motor shaft 10 and both are supported between a gear housing 11 and a gear housing 12. The intermediate shaft 13 in turn meshes with a bevel gear 18 slidably and rotatably slipped over an also rotatable cylinder 17 which is disposed coaxially with the main housing 2. Provided in front of the bevel gear 18 is a lock sleeve 19 which functions as a first means of changing the operating mode of the hammer drill 1. The lock sleeve 19 is spline-connected to the cylinder 17 so as to be integrally rotatable with the cylinder and axially slidable relative to the cylinder. Additionally, the lock sleeve 19 is urged rearwards by a coil spring 24 interposed between the sleeve 19 and a stopper ring 23 slidably and rotatably fit over the cylinder 17. Furthermore, the lock sleeve 19 is formed with engaging teeth 20 at its rear end that can mesh with coupling teeth 18*a* formed on an inner peripheral surface of the bevel gear 18. The lock sleeve 19 is additionally formed with a flange 21 which is formed with engaging teeth 22 on its front outer peripheral surface.

Still referring to FIG. 2, an intermediate sleeve 25 and the tool holder 26 are slipped over the front end of the cylinder 17. A plurality of balls 27 are fitted in the cylinder 17, the intermediate sleeve 25, and the tool holder 26 so as to connect these three elements 17, 25, and 26, thus allowing their integral rotation. The intermediate sleeve 25 defines the front limit of the stopper ring 23, whereas the tool holder 26 urges via another coil spring 30 a lock ring 28 which is spline-connected to the crank housing 12 on its outer surface and thus can only slide relative to the cylinder 17. Formed at the rear end of the lock ring 28 are lock teeth 29 that can mesh with engaging teeth 22 formed at the front end of the lock sleeve 19.

Figure 3:
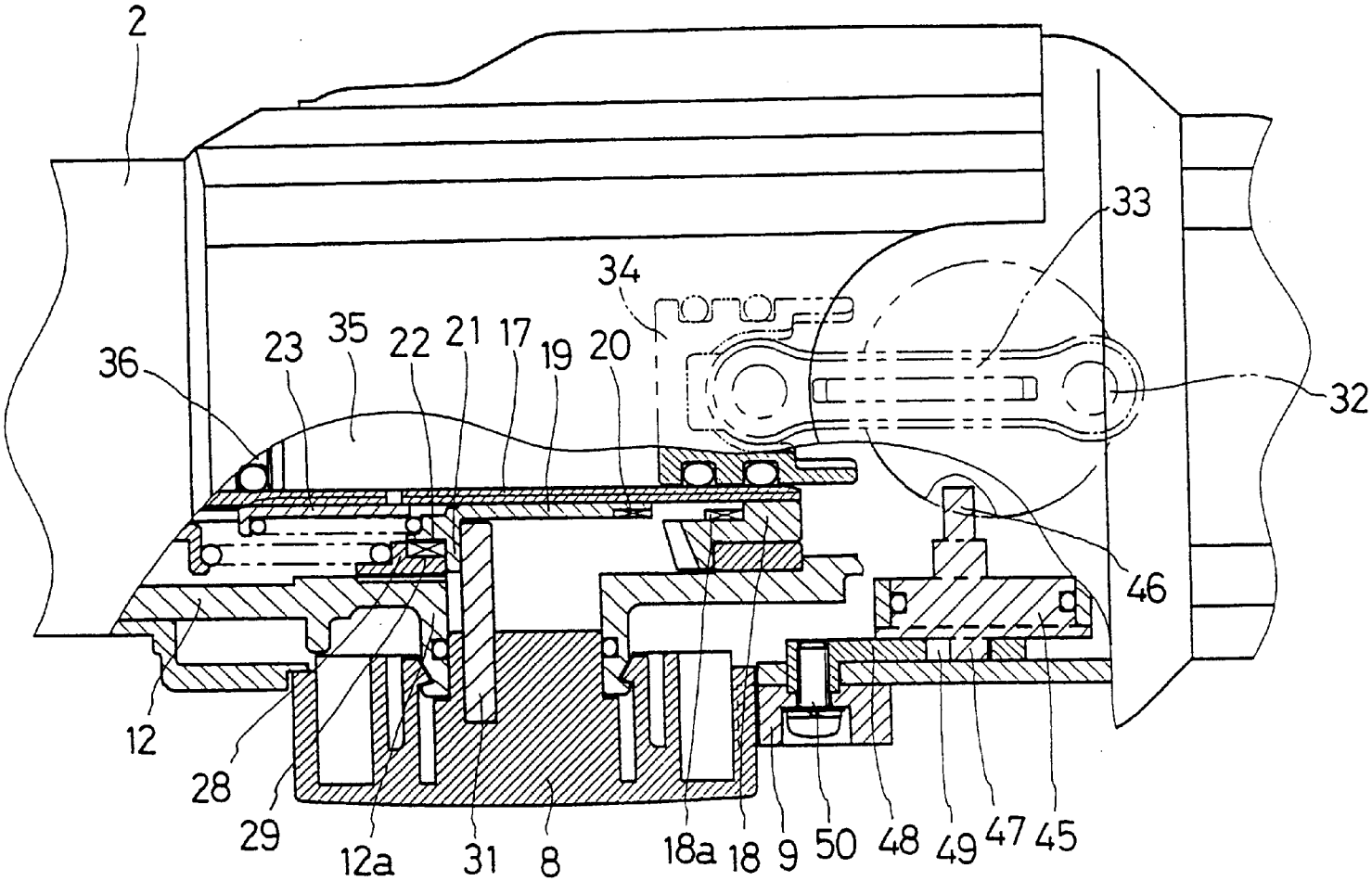
FIG. 3 is a partial cross section of the hammer drill of FIG. 1, showing rotary and slide levers in cross section when the hammer drill is placed in a hammer-only mode.

Referring now to FIG. 3, the rotary lever 8 is rotatably attached to a cylindrical portion 12*a* so as to protrude from a side portion of the crank housing 12. A change pin 31 is eccentrically implanted in the inner surface of the rotary lever 8 toward the cylinder 17 through the opening of the cylindrical portion 12*a* and comes into abutment with the rear surface of the flange 21 of the lock sleeve 19 so as to limit the rearward movement of the lock sleeve 19. In this embodiment, as shown in FIG. 3, when the change pin 31 is located in the forwardmost position, the lock sleeve 19 is also in its forwardmost position, bringing the engaging teeth 22 into mesh with the lock teeth 29 of the lock ring 28. When the rotary lever 8 is manually rotated 90 degrees, the change pin 31 moves rearward by the distance corresponding to its eccentricity from the center of the rotary lever 8, permitting the rearward movement of the lock sleeve 19 and thus disengaging the engaging teeth 22 from the lock teeth 29. This does not bring the engaging teeth 20 at the rear of the lock sleeve 19 into mesh or engagement with the coupling teeth 18*a* of the bevel gear 18. When the rotary lever 8 is manually rotated an additional 90 degrees so as to move the change pin 31 to its rearmost position, the lock sleeve 19 is also located in its rearmost position, in which the engaging teeth 20 is in engagement with the coupling teeth 18*a* of the bevel gear 18.

Still referring to FIG. 3, a vertically oriented eccentric pin 32 projects out of the upper surface of the crank shaft 14 and is coupled via a connecting rod 33 to a piston 34 which is inserted into the cylinder 17. This arrangement constitutes a crank mechanism for converting the rotation of the crank shaft 14 into the reciprocating motion of the piston 34. As shown in FIGS. 2 and 3, a striking element 36 and an intermediate element 37 which abuts the tool bit 4 are slidably disposed in front of piston 34 and within the cylinder 17, with an air chamber 35 defined between the striking element 36 and the piston 34. When the piston 34 reciprocates, the striking element 36 also reciprocates as it is pneumatically interlocked with the piston 34 by the air spring effect. This causes the striking element 36 to repeatedly ram the intermediate element 37, thus transmitting hammer blows to the tool bit 4.

Figure 4:
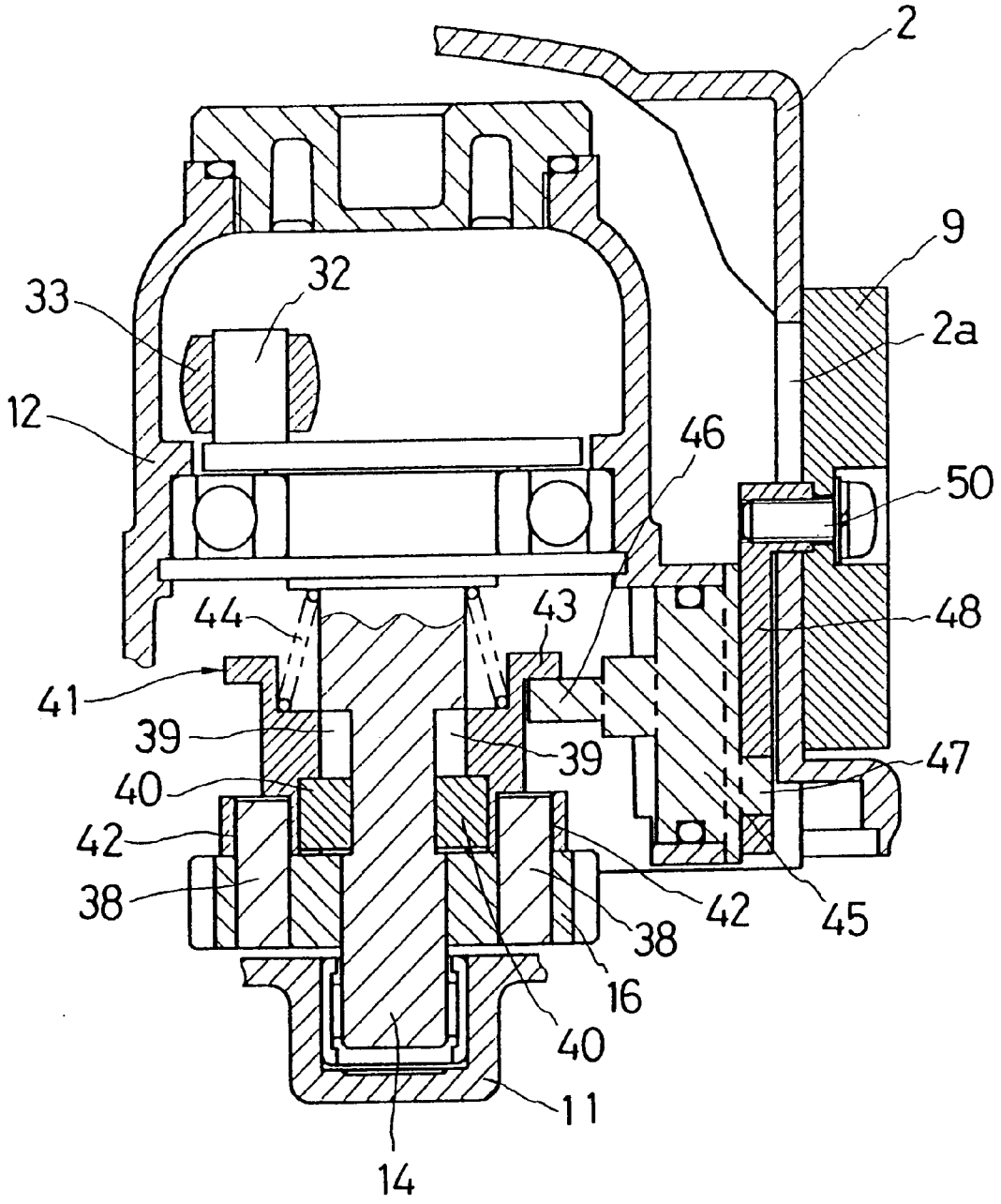
FIG. 4 is a cross section of a crank mechanism of the hammer drill of FIG. 1 when the mechanism is placed in condition for converting the rotation of a motor to reciprocating motion so as to transmit hammer blows to a tool bit attached to the drill.

With reference to FIG. 4, a pair of vertical pins 38 projects upward out of the upper surface of a gear 16 of the crank shaft 14. The gear 16 is slipped around the crank shaft 14 so as to selectively rotate integrally with the crank shaft 14 when hammer blows are to be transmitted to the tool bit 4 (see FIG. 4). The gear 16 is not interlocked with the crank shaft 14 when hammer blows are not to be transmitted to the tool bit 4 (see FIG. 5). The crank shaft 14 is formed with a pair of axial key grooves 39 in which a pair of keys 40 are fitted. The keys 40 are connected with a connection sleeve 41 which functions as a second means of changing the operating mode of the hammer drill 1. As illustrated, the connection sleeve 41 is fitted around the crank shaft 14 so as to be integrally rotatable with the crank shaft 14 and axially slidable with respect to the shaft 14. In addition, the connection sleeve 41 is urged toward the gear 16 by a coil spring 44. The connection sleeve 41 is formed with a pair of connection holes 42 on its underside for accommodating the pins 38 of the gear 16.

Figure 5:
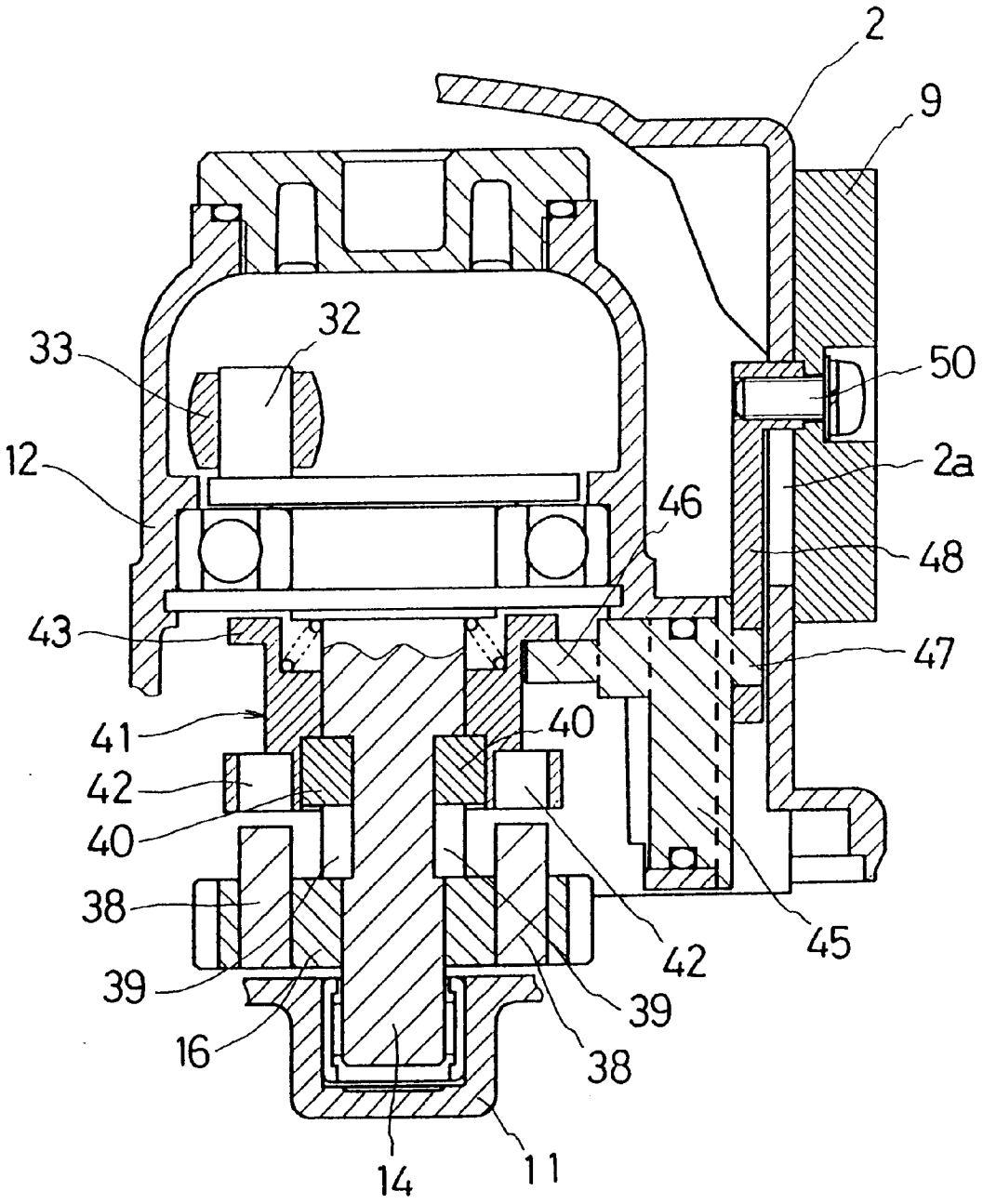
FIG. 5 is a cross section of a crank mechanism of FIG. 4 when the mechanism is disabled from converting the rotation of a motor to reciprocating motion.

Still referring to FIG. 4, the slide position of the connection sleeve 41 is determined by the position of a pin 46 abutting a flange formed around the upper edge of the connection sleeve 41. The pin 46 is eccentrically formed on a rotatable plate 45 supported by the crank housing 12. A circular protrusion 47 is also eccentrically provided on the opposite side of the rotatable plate 45 (see FIGS. 2, 7, 9, and 10). The protrusion 47 is fitted in a slot 49 formed the lower end of an L-shaped change-over lever 48 which is accommodated between the main housing 2 and the rotatable plate 45. The other end of the change-over lever 48 penetrates a vertical slot 2*a* formed in the main housing 2 and is secured to the slide lever 9 at the penetration by means of a screw 50. Therefore, when the slide lever 9 is pushed to its lowermost position, it rotates the rotatable plate 45 in the counterclockwise direction via the protrusion 47, as seen in FIG. 2. This also rotates and lowers the pin 46 on the opposite side of the rotatable plate 45 in the counterclockwise direction. This allows the connection sleeve 41 to be pushed down by the coil spring 44 so as to fit the connection holes 42 over the pins 38, thus connecting the sleeve 41 to the gear 16. When this occurs, the rotation of the gear 16 is transmitted to the crank shaft 14 via the connection sleeve 41 so as to impart reciprocating motion to the piston 34. As shown in FIG. 5, conversely, when the slide lever 9 is raised to its uppermost position, it rotates the rotatable plate 45 in the clockwise direction as seen in FIG. 2 via the protrusion 47. This also rotates and raises the pin 46 on the opposite side of the lever 48 also in the clockwise direction, thus removing the connection holes 42 from the pins 38. When this occurs, the gear 16 rotates idly without transmitting the rotation of the motor shaft 10 to the crank shaft 14.

Figure 9:
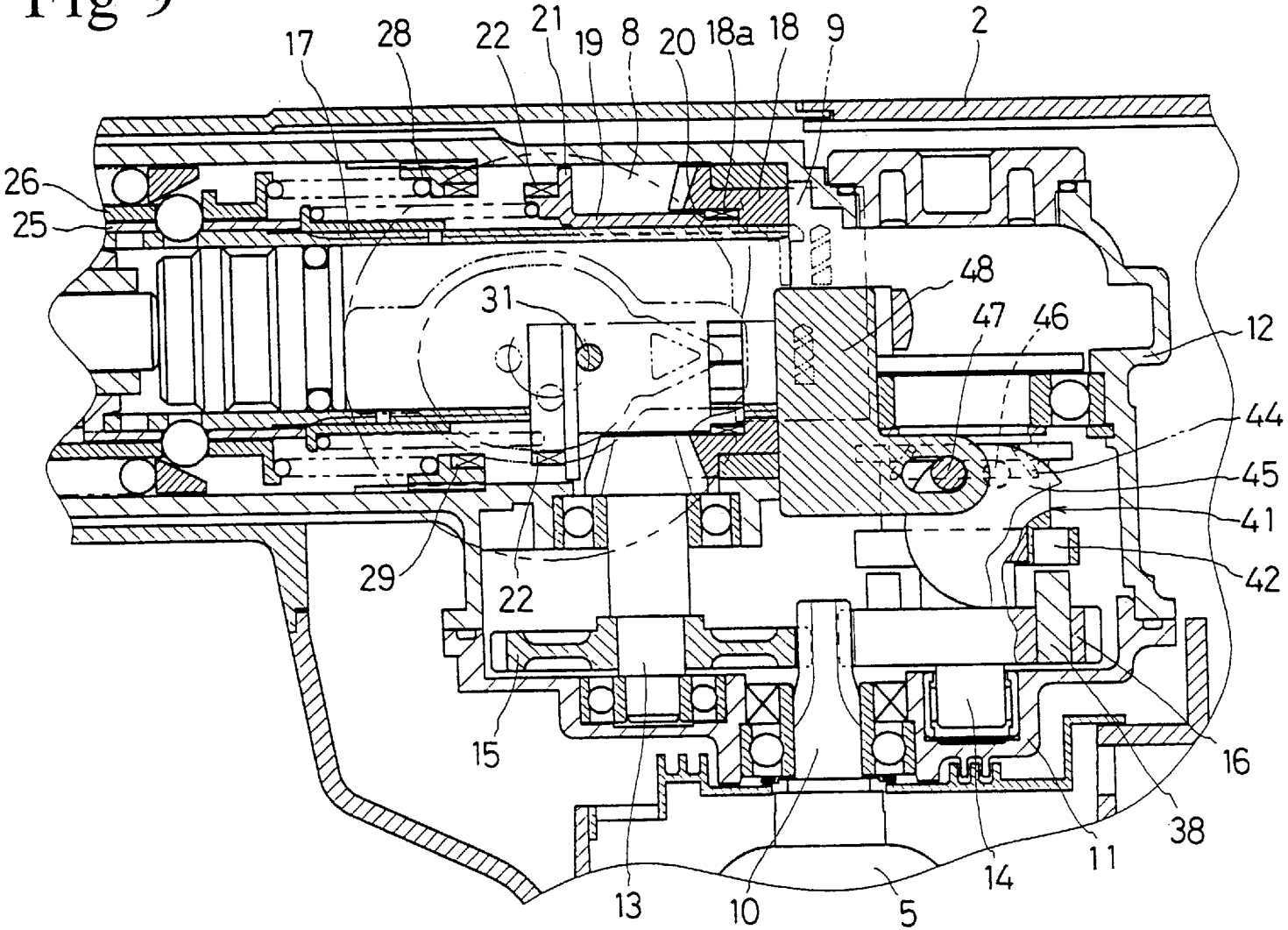
FIG. 9 is a cross section of the internal mechanisms of the hammer drill of FIG. 1 when the drill is placed in the rotation-only mode.

The protrusion 47 is displaced clockwise from the pin 46 on the rotatable plate 45 as seen in FIGS. 2, 7, 9, and 10 such that when the connection sleeve 41 is slid to the upper limit, the pin 46 rotates upward beyond the center of the rotatable plate 45 to the right half of the plate 45 as seen in FIG. 9. The reason for this configuration is that the pin 46, once shifted to this position, is biased downward by the connection sleeve 41, which is in constant abutment with the pin 46. This downward biasing force of the connection sleeve 41 urges the rotatable plate 45 clockwise, thus preventing unintentional counterclockwise return of the pin 46 to the position shown, for example, in FIG. 2. This means that the slide lever 9 is also prevented from accidental return to the lowermost position, thereby maintaining the operating mode selected by the operator.

Figure 6A:
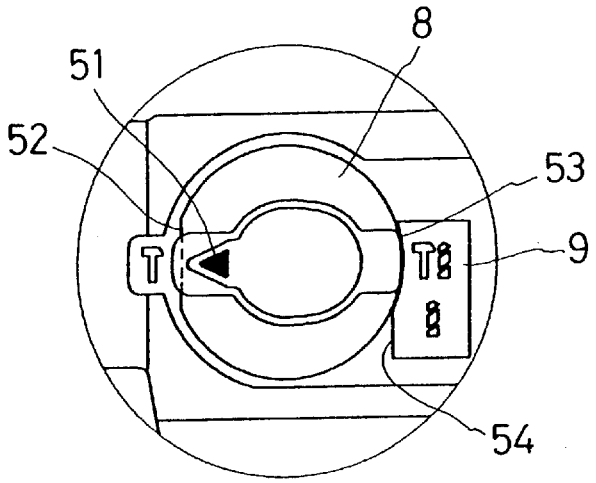
FIG. 6A shows the positions of the rotary and slide levers when the hammer drill of FIG. 1 is placed in a hammer-only mode.
Figure 6B:
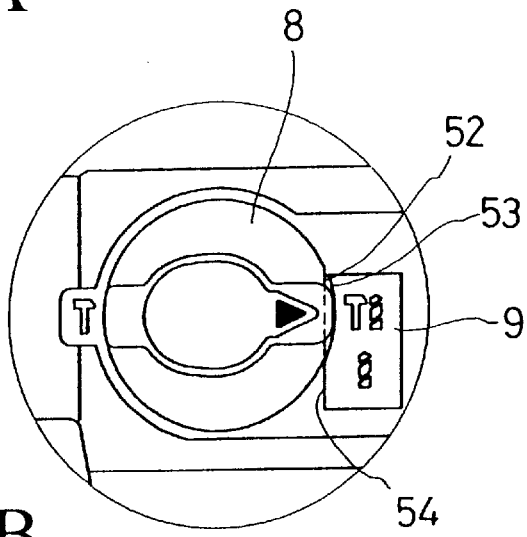
FIG. 6B shows the positions of the rotary and slide levers when the hammer drill of FIG. 1 is placed in a hammer plus rotation mode.
Figure 6C:
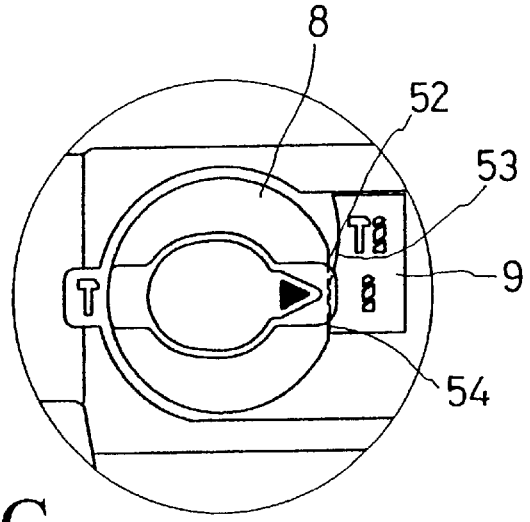
FIG. 6C shows the positions of the rotary and slide levers when the hammer drill of FIG. 1 is placed in a rotation-only mode.

As shown, for example, in FIGS. 2 and 6A to 6C, the rotary lever 8 is marked with an arrow 51 on the eccentric side thereof, where the change pin 31 is located, in order to indicate the rotational position of the lever 8. In addition, the rotary lever 8 is formed with a chamfer 52 on the part of its circumferential edge at which the arrow 51 points. The slide lever 9 includes at its upper left side a circular cut-out 53 that matches the circumference of the rotary lever 8 and a straight portion 54 that is located below the cut-out 53 and extends toward the rotary lever 8. Combined together, the cut-out 53, the chamfer 52, and the straight portion 54 constitute means to lock the movement of the two levers 8 and 9. More particularly, as shown in FIG. 6A, when the slide lever 9 is located in the lowermost position, that is, in which the circular edge of the rotary lever 8 fits in the cut-out 53, the slide lever 9 is locked in the position. In other words, the slide lever 9 cannot be slid upward to its uppermost position. The lever 9 cannot be slid upward unless the chamfer 52 of the rotary lever 8 is rotated to its rearward position as shown in FIG. 6B. As shown in FIG. 6C, when the slide lever 9 is in its uppermost position, the straight portion 54 closely opposes the chamfer 52 across a narrow gap so that the rotary lever 8 is locked in the position, thus preventing the lever 8 from being rotated. In order to rotate the lever 8 as shown in FIG. 6B, the slide lever 9 is pulled down to its lowermost position, in which the cut-out 53 opposes the chamfer 52.

In the operation of the hammer drill 1, when the rotary lever 8 is rotated to the position shown in FIG. 2, 3, and 6A, in which the change pin 31 is located in the forwardmost position, with the slide lever 9 located in its lowermost position, the lock sleeve 19 is disengaged from the bevel gear 18 so as to engage and prohibit movement of the lock ring 28. Therefore, rotation of the lock sleeve 19 is prohibited, thus preventing rotation of the cylinder 17 and the tool holder 26. As shown in FIG. 4, since the slide lever 9 is located in its lowermost position, the connection sleeve 41 is located in its lowermost position, linking the crank shaft 14 to the gear 16 and thus allowing the rotation of the crank shaft 14. The operating mode currently selected is referred to as a hammer-only mode, in which the rotation of the bevel gear 18 is not transmitted to the tool bit 4, but hammer blows caused by the reciprocating motion of the piston 34 are transmitted to the bit 4. In its lowermost position with the circumferential edge of the rotary lever 8 fitted in the cut-out 53, the slide lever 9 is prevented from shifting to the uppermost position (the "off" position).

Figure 7:
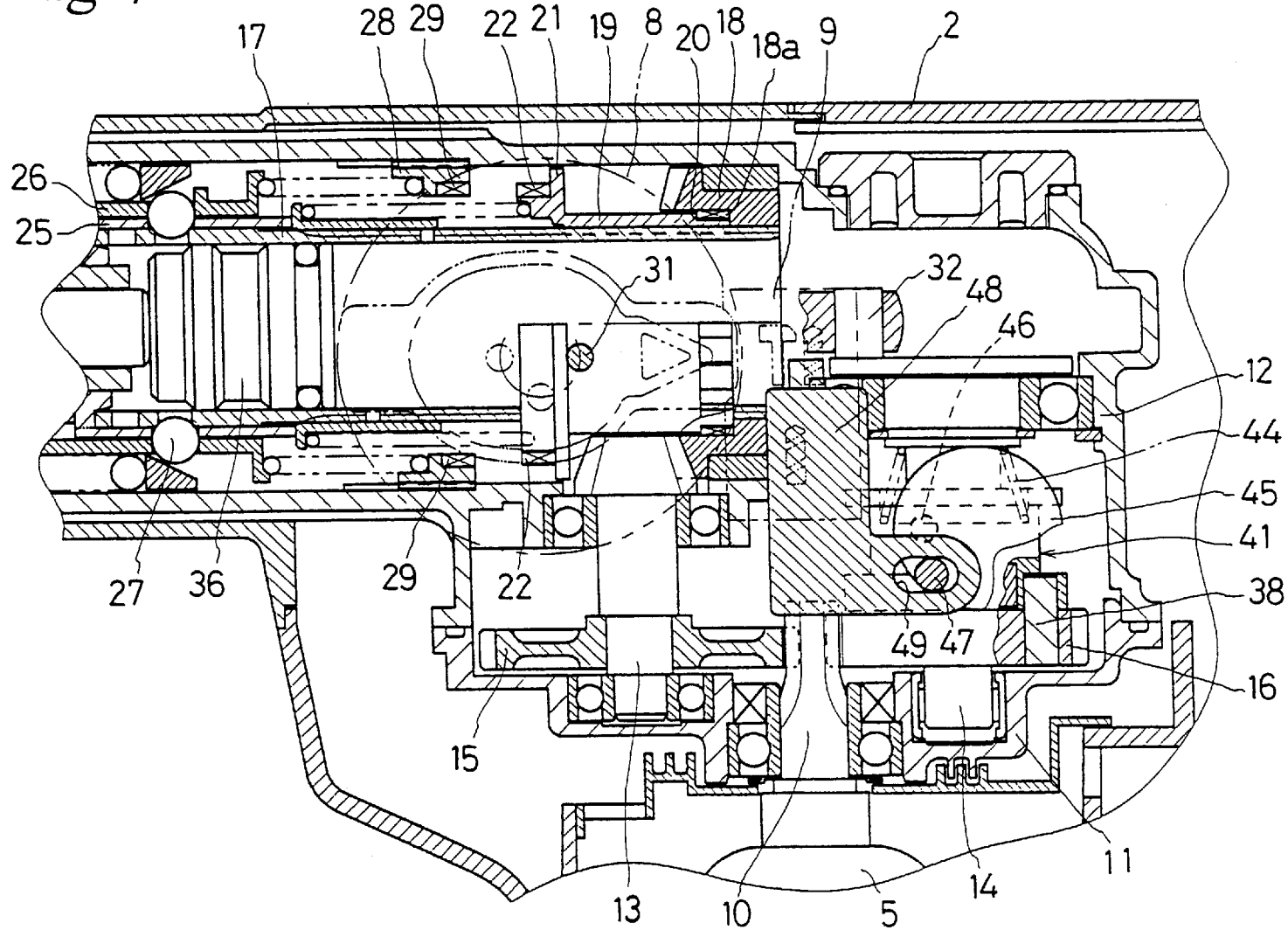
FIG. 7 is a cross section of the internal mechanisms of the hammer drill of FIG. 1 when the drill is in the hammer plus rotation mode.
Figure 8:
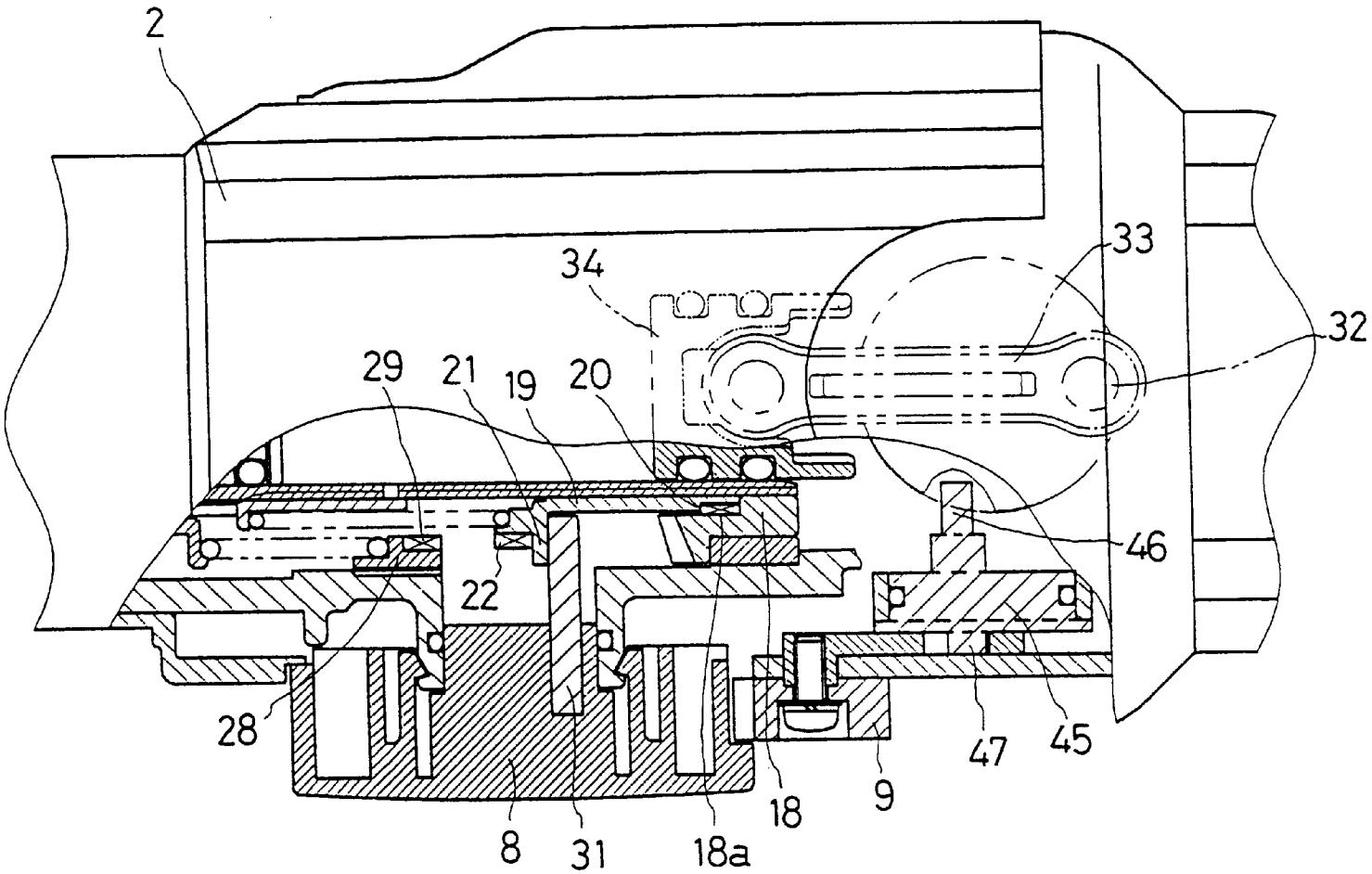
FIG. 8 is a partial cross section of the hammer drill, showing the rotary and slide levers in cross section when the hammer drill is placed in the hammer plus rotation mode.

When the rotary lever 8 is rotated 180 degrees to the position shown in FIGS. 6B, 7, and 8, the change pin 31 moves rearward so that the lock sleeve 19 disengages itself from the lock ring 28 and engages the bevel gear 18. This results in transmission of the rotation of the intermediate shaft 13 to the lock sleeve 19 via the bevel gear 18, thus rotating the cylinder 17 and the tool holder 26 as they can rotate integrally with the lock sleeve 19. Subsequently, therefore, the tool bit 4 is rotated to operate on a workpiece. The operating mode currently selected is referred to as a rotation-plus-hammer mode, in which both the rotation of the bevel gear 18 and the hammer blows caused by the reciprocating motion of the piston 34 are transmitted to the tool bit 4.

By sliding the slide lever 9 upward to the uppermost position as shown in FIGS. 6C and 9 when the hammer drill 1 is placed in the rotation-plus-hammer mode, the change-over lever 48 is raised so as to rotate the rotatable plate 45 in the clockwise direction. This causes the pin 46 to raise the connection sleeve 41, thus decoupling the crank shaft 14 from the gear 16. Therefore, the crank shaft 14 no longer rotates to impart reciprocating motion to the piston 34. The operating mode currently selected is referred to as a rotation-only mode, in which the rotation of the motor 5 is transmitted to the tool bit 4 via the intermediate shaft 13, the bevel gear 18, the lock sleeve 19, the cylinder 17, and the tool holder 26, but no hammer blow is transmitted to the bit 4. In this mode, as the chamfer 52 of the rotary lever 8 closely opposes the straight portion 54 of the slide lever 9 across a narrow gap, the rotary lever 8 cannot be rotated to the forward most position (the "off" position) due to the interference with the straight portion 54. As described above, the rotary lever 8 cannot be rotated to the forward most position unless the slide lever 9 is pulled down to its lowermost position.

Figure 10:
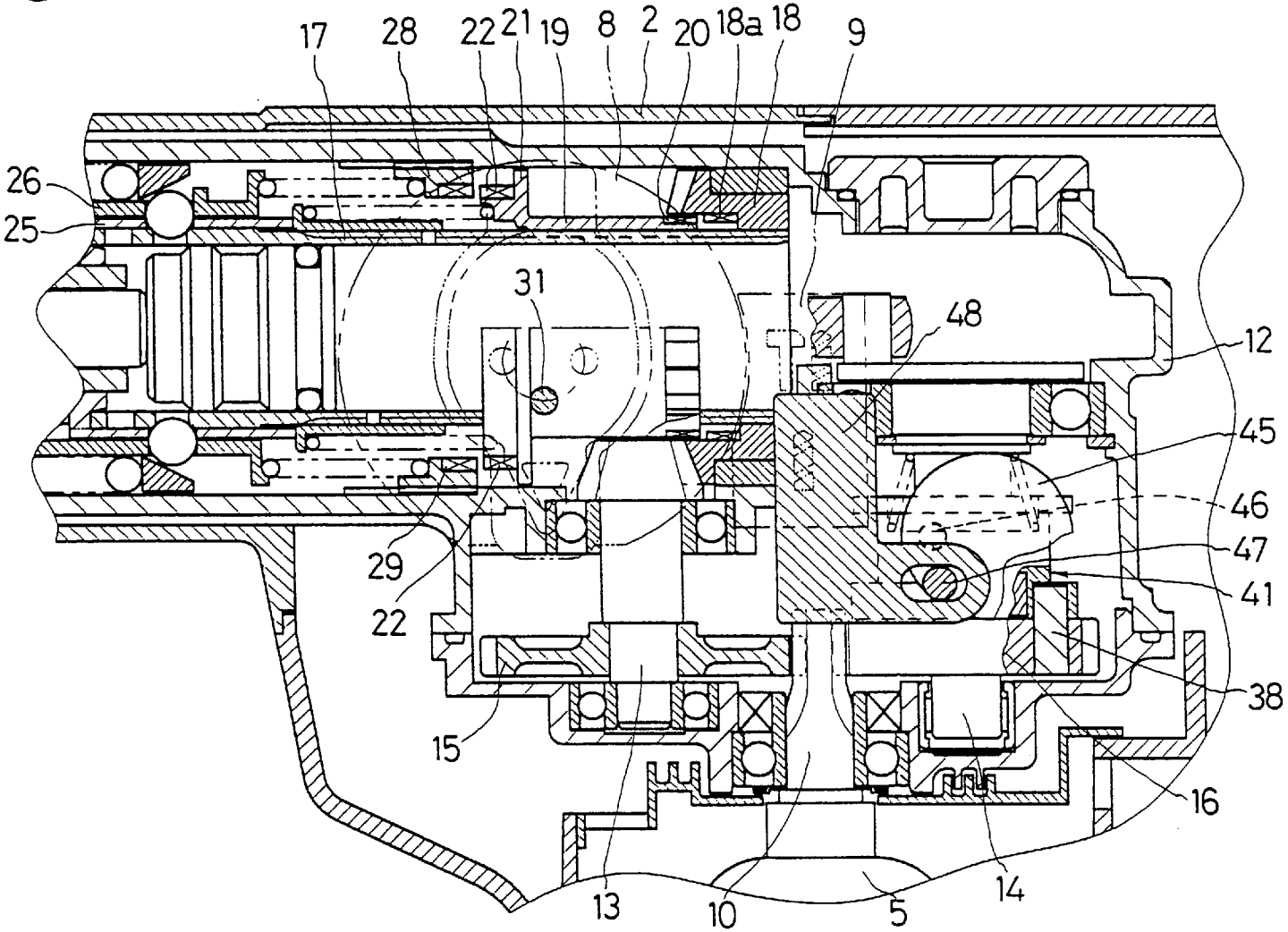
FIG. 10 is a cross section of the internal mechanisms of the hammer drill of FIG. 1 in a neutral state in which the tool bit can be manually rotated to a desired rotary angle.
Figure 11:
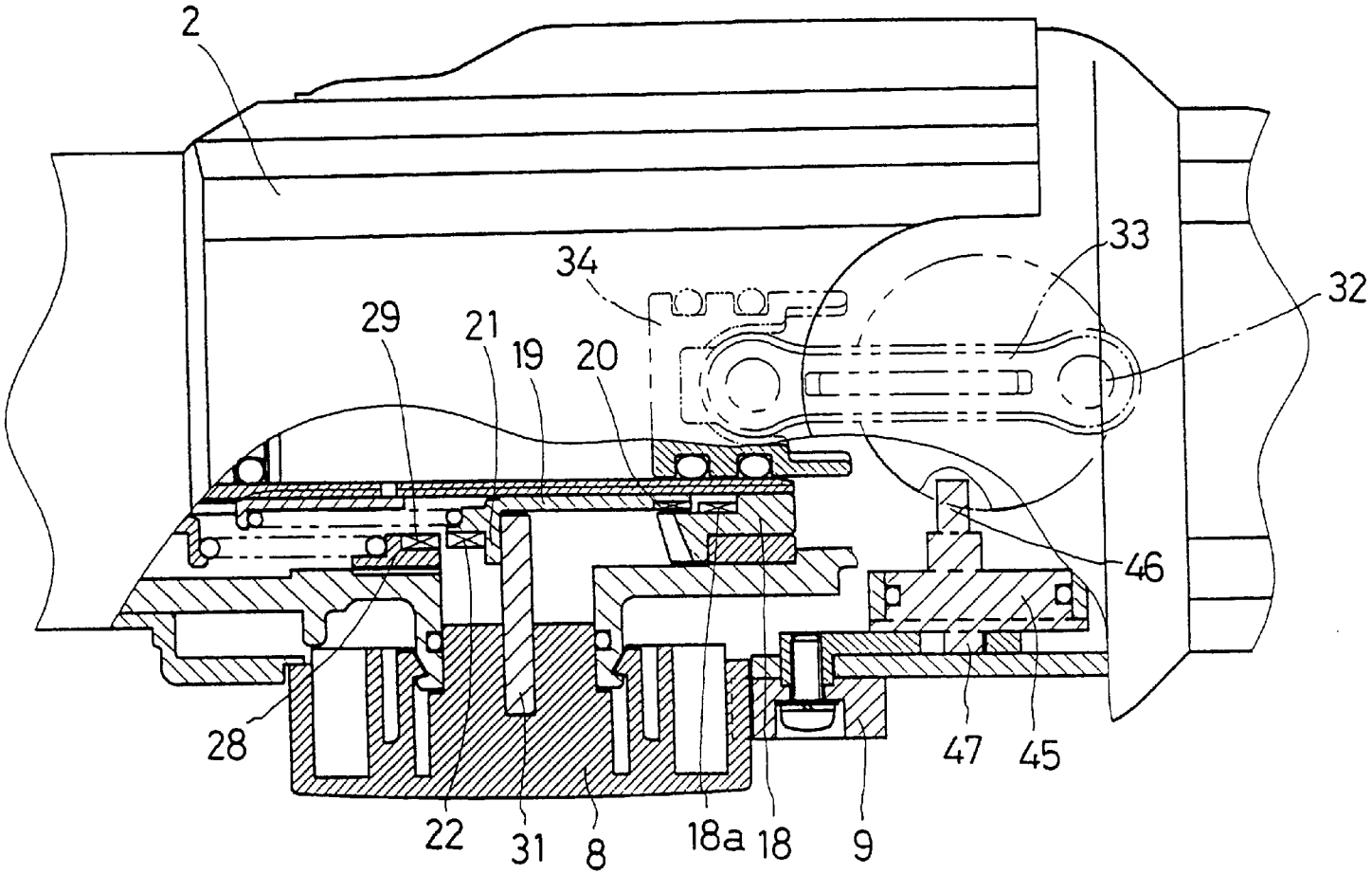
FIG. 11 is a partial cross section of the hammer drill, showing the rotary and slide levers in cross section when the hammer drill is placed in the neutral state.

If the rotary lever 8 is rotated downward 90 degrees from the position shown in FIG. 2 or 7 to the middle position as shown in FIGS. 10 and 11 so as to direct the arrow 51 vertically downward, the lock sleeve 19 moves to a neutral position in which it engages neither the lock ring 28 nor the bevel gear 18. Therefore, the cylinder 17 and the tool holder 26 can be freely rotated by manual operation. When the motor 5 is turned off, the operator can rotate the tool holder 26 and thus the tool bit 4 to a desired rotary angle. By rotating the change pin 31 ninety degrees to the forwardmost position, the operator can place the hammer drill 1 in the hammer-only mode (see FIG. 2), in which the tool holder 26 and the tool bit 4 are locked at the selected rotary position due to the reestablished engagement between the lock ring 28 and the lock sleeve 19. This arrangement is convenient for use with a chisel or other tool bit whose rotary angle often needs to be selected.

Even in the neutral position, the circular edge of the rotary lever 8 remains fitted in the cut-out 53 of the slide lever 9 to maintain the lever 9 in the lowermost position. Therefore, the crank shaft 14 remains interlocked with the gear 16, still imparting reciprocating motion to the piston 34. In this way, an off/off state, in which the tool bit cannot provide rotation or hammer blows, can be avoided.

According to the embodiment, one of three operating modes (the hammer-only mode, the hammer plus rotation mode, and the rotation-only mode) can be selected by the operation of the rotary lever 8 and the slide lever 9. Moreover, the lock means (the combination of the chamfer 52, the cut-out 53, and the straight portion 54) prevents one lever from moving to its "off" position as long as the other lever is in the "off" position. In other words, the off/off state, in which the tool bit can neither provide rotation nor hammer blows, can be avoided so as to realize a highly operable hammer drill which allows easy and reliable mode selection.

As the slide lever 9 slides tangentially to the rotary lever 8 only when the straight portion 54 opposes the chamfer 52, and the rotary lever 8 can be rotated only when its circular edge is fitted in the cut-out 53, the lock means easily and selectively locks either lever in a manner that logically suggests the purpose of the lever (that is, the rotary lever is rotated to enable or disable the rotation of the tool bit, whereas the slide lever is moved linearly, i.e., slid, to enable or disable the reciprocating motion of the tool bit).

According to the foregoing embodiment, a first switch device (the rotary lever) is rotated in order to enable or disable the rotation of the tool bit, whereas a second switch device (the slide lever) is slid to enable or disable the reciprocating motion of the tool bit, as described above. However, the opposite arrangement may be adopted without departing from the scope of the invention (i.e., the rotary lever is operated in order to enable or disable the reciprocating motion of the tool bit, whereas the slide lever is operated to enable or disable the rotation motion of the tool bit). Alternatively, both levers may be operated by either slide or rotary motion. Furthermore, the mechanisms to transmit rotation and hammer blows that are enabled or disabled by the two levers need not be structured according to the foregoing embodiment; they may be changed, altered, or modified to suit specific applications.

According to the present invention, first and second operating members enable mode switching among three operating modes of an electric power drill. Furthermore, although two operating members are used, a lock means coordinates the two operating members to prohibit the two operating members from moving to their respective "off" positions at the same time, thus preventing the tool from entering an "off-off" state. In other words, while one operating member is in the position in which the operation of the motor is not transmitted to the tool bit, movement of the other operating member to the position in which the operation of the motor is not transmitted to the tool bit is prohibited. This ensures easy and accurate selection of a desired operating mode, thus providing an electric power tool with an improved operability.

Moreover, the lock means can be realized in simple and logical construction by the particular configurations of the operating members, a cut-out, and a chamfer formed on the operating members.

Equivalents

It will thus be seen that the present invention efficiently attains the objects set forth above, among those made apparent from the preceding description. As other elements may be modified, altered, and changed without departing from the scope or spirit of the essential characteristics of the present invention, it is to be understood that the above embodiments are only an illustration and not restrictive in any sense. The scope or spirit of the present invention is limited only by the terms of the appended claims.

What is claimed is:

1. A hammer drill, comprising:

a chuck mounted on a front end of the hammer drill;

a motor for providing drive power for the chuck;

a rotation transmission mechanism provided between the chuck and the motor for transmitting rotation of the motor to the chuck;

an impact transmission mechanism provided between the chuck and the motor for transmitting hammer blows generated by the motor to the chuck;

a first change-over member associated with the rotation transmission mechanism for selectively enabling and disabling the rotation transmission mechanism to transmit the rotation of the motor to the chuck;

a second change-over member associated with the impact transmission mechanism for selectively enabling and disabling the impact transmission mechanism to transmit the hammer blows generated by the motor to the chuck;

a manually operable first operating member movable between operative and inoperative positions, wherein the first operating member, when in the operative position, operates the first change-over member so as to enable the rotation transmission mechanism and, when in the inoperative position, operates the first change-over member to disable the rotation transmission mechanism;

a manually operable second operating member movable between operative and inoperative positions, wherein the second operating member, when in the operative position, operates the second change-over member so as to enable the impact transmission mechanism and, when in the inoperative position, operates the second change-over member to disable the impact transmission mechanism; and a lock means for, when one of the first and second operating members is in its inoperative position, coordinating with the other operating member so as to prohibit the other operating member from moving to its inoperative position.

2. A hammer drill in accordance with claim 1, wherein one of the first and second operating members is a circular rotary lever and the other operating member is a slide lever slidable tangentially to the rotary lever, and further wherein the lock means comprises a cut-out formed in an edge of the slide lever for fitting the circumferential edge of the rotary lever so as to prevent the slide lever to slide when the slide lever is in its operative position, and a chamfer formed on a portion of the circumferential edge of the rotary lever such that when the rotary lever is rotated to the operative position, the chamfer is positioned adjacent the slide lever so as to allow the slide lever to slide, and when the rotary lever is rotated to the operative position and the slide lever is in its inoperative position, the chamfer closely opposes an edge of the slide lever so as to prohibit rotation of the rotary lever.

3. A hammer drill in accordance with claim 2, wherein the first operating member is the rotary lever and the second operating member is the slide lever, and further wherein the rotary lever and the slide lever are disposed on a line parallel to a longitudinal axis of the chuck, with the rotary lever interposed between the chuck and the slide lever.

4. A hammer drill in accordance with claim 3, wherein the slide lever has a generally rectangular shape, being slidable on the rotary lever and perpendicularly to the parallel line between its operative and inoperative positions.

5. A hammer drill in accordance with claim 4, wherein the rotary lever is rotated 180 degrees around a second axis from its inoperative position to its operative position, the second axis intersecting and oriented perpendicularly to the parallel line.

6. A hammer drill in accordance with claim 5, wherein the cut-out is formed in a portion of the long side of the slide lever which is adjacent to the rotary lever, leaving a portion of the long side intact where the cut-out is not formed, the intact side edge closely opposing the chamfer of the rotary lever when the rotary lever is in its operative position and the slide lever is in the inoperative position such that the rotary lever cannot be rotated back to its inoperative position unless the slide lever is slid back to its operative position.

7. A hammer drill in accordance with claim 6, wherein the first change-over member is a sleeve member which is rotatably disposed within a housing of the hammer drill about the longitudinal axis and slid along the longitudinal axis between an operative position, in which the rotation transmission mechanism is enabled, and an inoperative position, in which the rotation transmission mechanism is disabled, and further wherein the sleeve member is interlocked with the rotation transmission mechanism so as to be rotated by the motor when in the operative position and is disengaged from the rotation transmission mechanism and secured to the housing so as to be prevented from rotating when in the inoperative position.

8. A hammer drill in accordance with claim 7, wherein, when the rotary lever is rotated approximately 90 degrees from either of the operative and inoperative positions to an intermediate position, the sleeve member is neither secured to the housing nor interlocked with the rotation transmission mechanism, thus permitting manual adjustment of the rotary angle of the sleeve member.

9. A hammer drill in accordance with claim 8, wherein the rotary lever bears a mark adjacent to the chamfer for indicating the location of the first change-over member between its operative and inoperative positions.

10. A hammer drill in accordance with claim 9, wherein the impact transmission mechanism comprises a crank mechanism connected to the rotor for converting the rotation of the motor into reciprocation motion as the hammer blows, and further wherein the second change-over member interlocks the motor to the crank mechanism when the slide lever is in the operative position, thus enabling the crank mechanism, and the second change-over member disengages the crank mechanism from the motor when the slide lever is in the inoperative position, thus disabling the crank mechanism.

* * * * *